US005327329A

United States Patent [19]

Stiles

[11] Patent Number: 5,327,329

[45] Date of Patent: Jul. 5, 1994

[54] LIGHTING ATTACHMENTS FOR IN-LINE ROLLER OR BLADE SKATES

[76] Inventor: David L. Stiles, 56 Mt. Lebanon Dr., Wheeling, W. Va. 26003

[21] Appl. No.: 36,155

[22] Filed: Mar. 24, 1993

[51] Int. Cl.[5] ..... A63C 17/26

[52] U.S. Cl. ..... 362/61; 362/253; 362/800; 280/810

[58] Field of Search ..... 362/61, 253, 800, 103; 280/809, 811

[56] References Cited

U.S. PATENT DOCUMENTS

| | | | |
|---|---|---|---|
| 4,367,515 | 1/1983 | Beard | 362/103 |
| 4,463,412 | 7/1984 | Broach | 362/61 |
| 4,761,720 | 8/1988 | Solow | 362/252 |
| 4,909,523 | 3/1990 | Olson | 280/11.2 |
| 4,991,066 | 2/1991 | McCowan | 362/61 |
| 4,997,196 | 3/1991 | Wood | 280/87.041 |
| 5,033,212 | 7/1991 | Evanyk | 36/137 |

*Primary Examiner*—Ira S. Lazarus
*Assistant Examiner*—L. Heyman
*Attorney, Agent, or Firm*—Richard C. Litman

[57] ABSTRACT

A lighting apparatus for use with in line blade type skates ("Rollerblade" or ice skates) may be temporarily applied to the sides of the blade below the arch of the skate, with the control box temporarily secured within the opening in the arch. The control box may contain the battery power supply, an on/off switch, and optionally may include a circuit providing for the intermittent flashing of the light(s). The lights are included in one or more small tubes which are applied to one or both sides of the skate. Each tube preferably contains a series of lights (preferably light emitting diodes) wired up to the switch, power supply and (optional) flasher circuit. When the switch is turned on, the light display provides an attractive addition to a skating performance and may substantially increase safety when a skater is skating outdoors at night.

2 Claims, 3 Drawing Sheets

FIG. 3
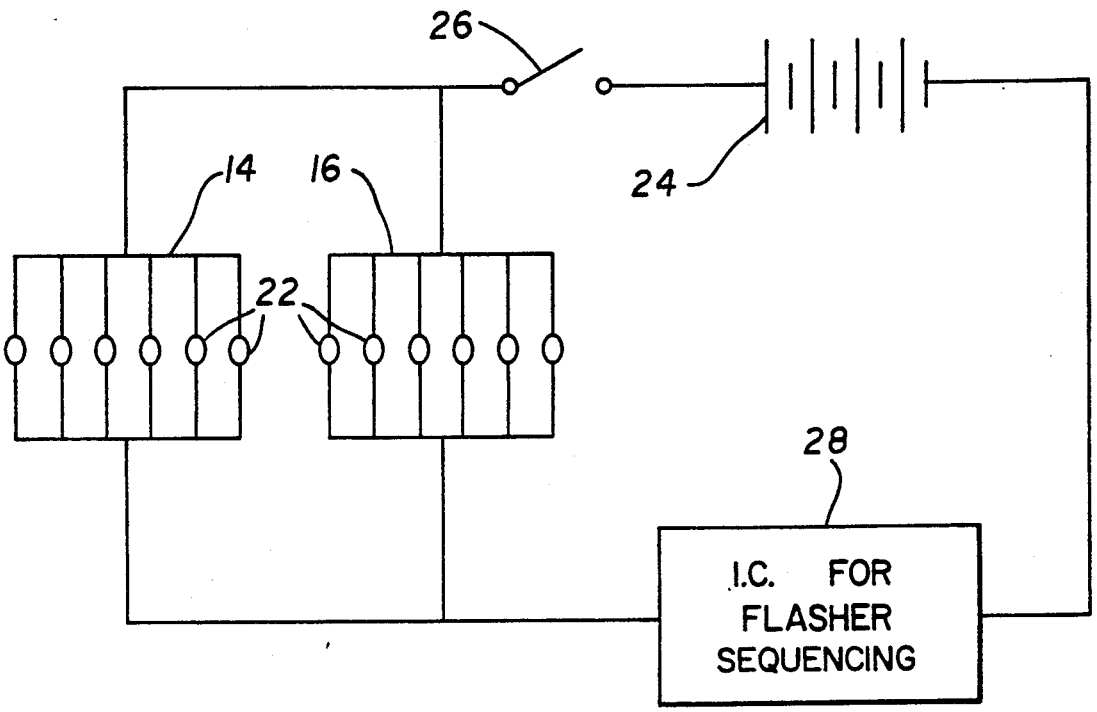
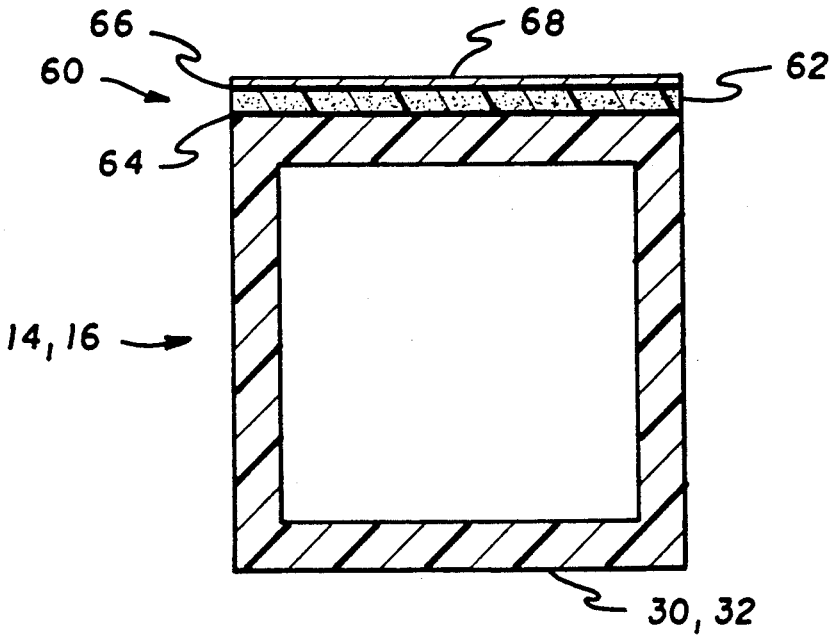
FIG. 4

LIGHTING ATTACHMENTS FOR IN-LINE ROLLER OR BLADE SKATES

FIELD OF THE INVENTION

The present invention relates generally to decorative lighting devices, and more specifically to a lighting apparatus for application to in-line roller skates ("Rollerblades," TM) or conventional bladed skates such as ice skates.

BACKGROUND OF THE INVENTION

Skating has become an ever more popular activity, and persons of all ages are enjoying it on an ever increasing basis. The relatively recent development of inline wheeled type skates ("Rollerblades," TM) has supplanted conventional roller skates to a great extent, and provide much the same feel as do ice skates due to their ability to lean or bank while turning, as well as their use of similar physical principles by the skater.

While in line roller type skates and ice skates provide a somewhat similar "feel," they are of course used in considerably different environments. Nevertheless, specialized rinks for both types of skates have been constructed for persons to skate in a controlled area, and many persons also use such skates (particularly in-line roller skates) outdoors.

Among other aspects of skating, it is a social activity, and many skaters may wish to "dress up" their skates or costumes in much the same manner as they might wear jewelry or some other ornament(s) for some other activity. As the lighting at a skating rink (as well as outdoors at night) is often relatively subdued, some addition to the skates which provides an interesting display of lighting would be much appreciated by many skaters. Moreover, such lights can prove to be a significant safety improvement for skaters who are skating outdoors or on roadways at night.

The need arises for a lighting apparatus adaptable to skates of various types. The apparatus must be relatively lightweight in order to avoid tiring the skater excessively, and must be relatively durable due to their installation near the bottom of the skate an subsequent physical abuse which may be incurred. The apparatus must also be relatively inexpensive, and must be adaptable to various types of skates, such as inline roller skates as well as ice skates.

DESCRIPTION OF THE PRIOR ART

U.S. Pat. No. 4,367,515 issued to Steven F. Baird on Jan. 4, 1983 discloses a Roller Skate Light Attachment in which a plurality of light emitting diodes (LEDs) are installed within a translucent toe stop on a conventional roller skate. At least the toe stop of the skate must be extensively modified in order to provide for such lighting, and the lights cannot be seen from all directions due to their installation only at the front of the skate.

U.S. Pat. No. 4,463,412 issued to Ronald W. Broach on Jul. 31, 1984 discloses an Illuminated Shoe Skate Attachment which provides a plurality of brackets attachable under the skate and including lights, as well as a translucent toe cover with internal lighting. The multitude of brackets, as well as the positions of the numerous lights thereon, provide for a device unlike that of the present invention.

U.S. Pat. No. 4,761,720 issued to Joseph E. Solow on Aug. 2, 1988 discloses an Illuminated Tape in which a plurality of LEDs are imbedded. No specific means of application in the manner of the present invention is disclosed.

U.S. Pat. No. 4,997,196 issued to John L. Wood on Mar. 5, 1991 discloses an Illuminated Skateboard having a peripheral groove containing a plurality of LEDs. The skateboard must be modified in order to provide the peripheral groove for the installation of the lights, and bears no resemblance to the present invention.

Finally, U.S. Pat. No. 5,033,212 issued to Walter R. Evanyk on Jul. 23, 1991 discloses a System For Increasing The Visibility Of An Object comprising one or more LEDs permanently imbedded in a jogging shoe or the like. The permanent installation of such lights in the shoe increases the cost of the shoe, and requires replacement of the entire shoe in the event the light(s) prematurely break down.

None of the above noted patents, taken either singly or in combination, are seen to disclose the specific arrangement of concepts disclosed by the present invention.

SUMMARY OF THE INVENTION

By the present invention, an improved apparatus providing supplementary illumination for skates is disclosed.

Accordingly, one of the objects of the present invention is to provide an apparatus providing supplementary lighting for skates which is adaptable to either in line roller type skates or blade type skates.

Another of the objects of the present invention is to provide an apparatus providing lighting for skates, which requires no modification of such skates.

Yet another of the objects of the present invention is to provide an apparatus providing lighting for skates, which is quickly and easily attachable to and detachable from such skates.

Still another of the objects of the present invention is to provide such a lighting apparatus which is of relatively simple construction and economical manufacture.

A further object of the present invention is to provide such an apparatus which may include one or more lights on either or both sides of a skate.

An additional object of the present invention is to provide such a lighting apparatus which may include means for intermittently flashing the lights.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 3 is an electrical schematic of the present invention.

FIG. 4 is an enlarged scale sectional view through one of the two lighting arrays of the invention, the light lamps being omitted for purposes of clarity of the view.

Similar reference characters denote corresponding features consistently throughout the several figures of the attached drawings.

DETAILED DESCRIPTION OF THE PREFERRED EMBODIMENT

Figure 1:
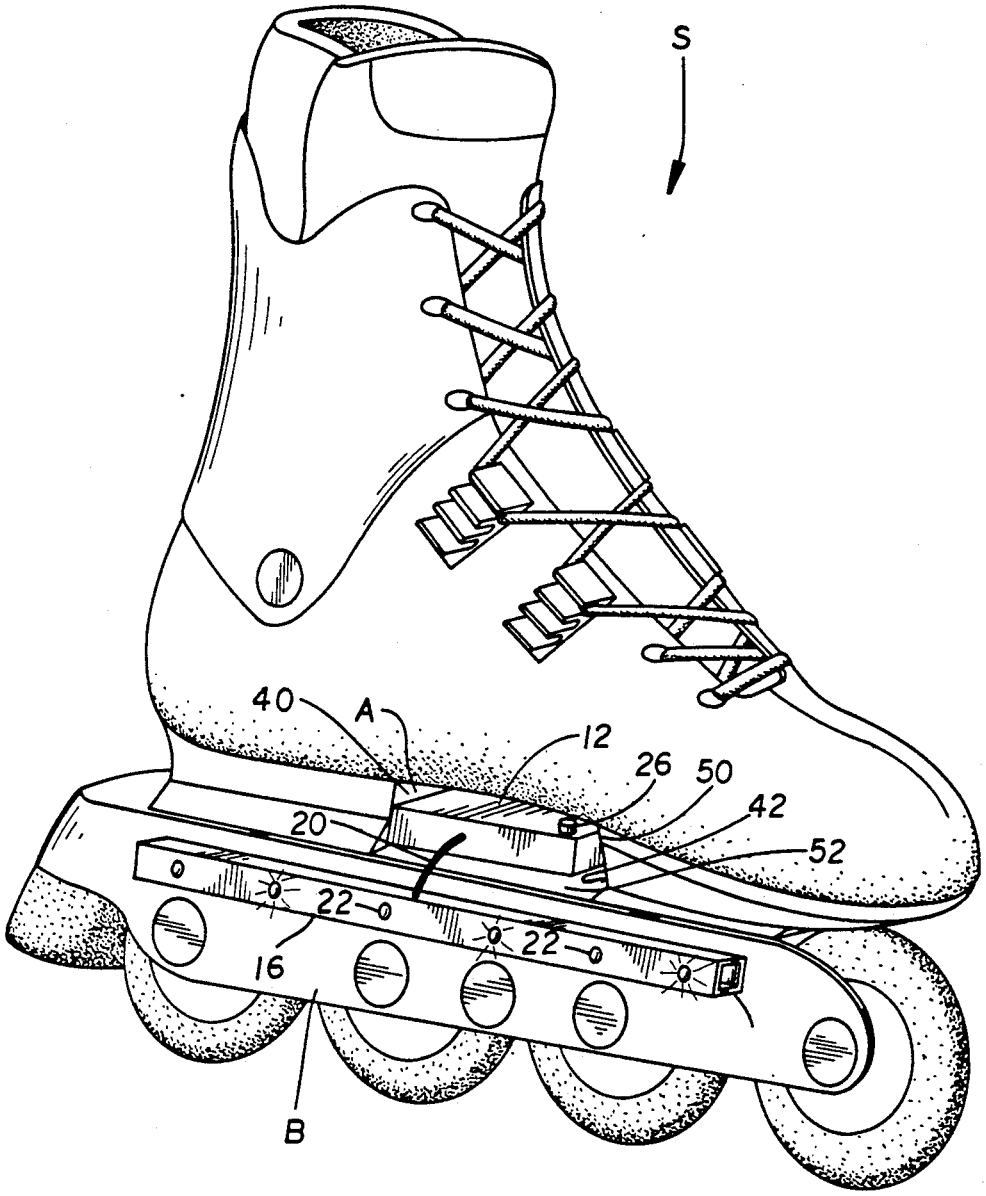
FIG. 1 is a perspective view of an in line type roller skate showing the installation and operation of the present invention thereon.
Figure 2:
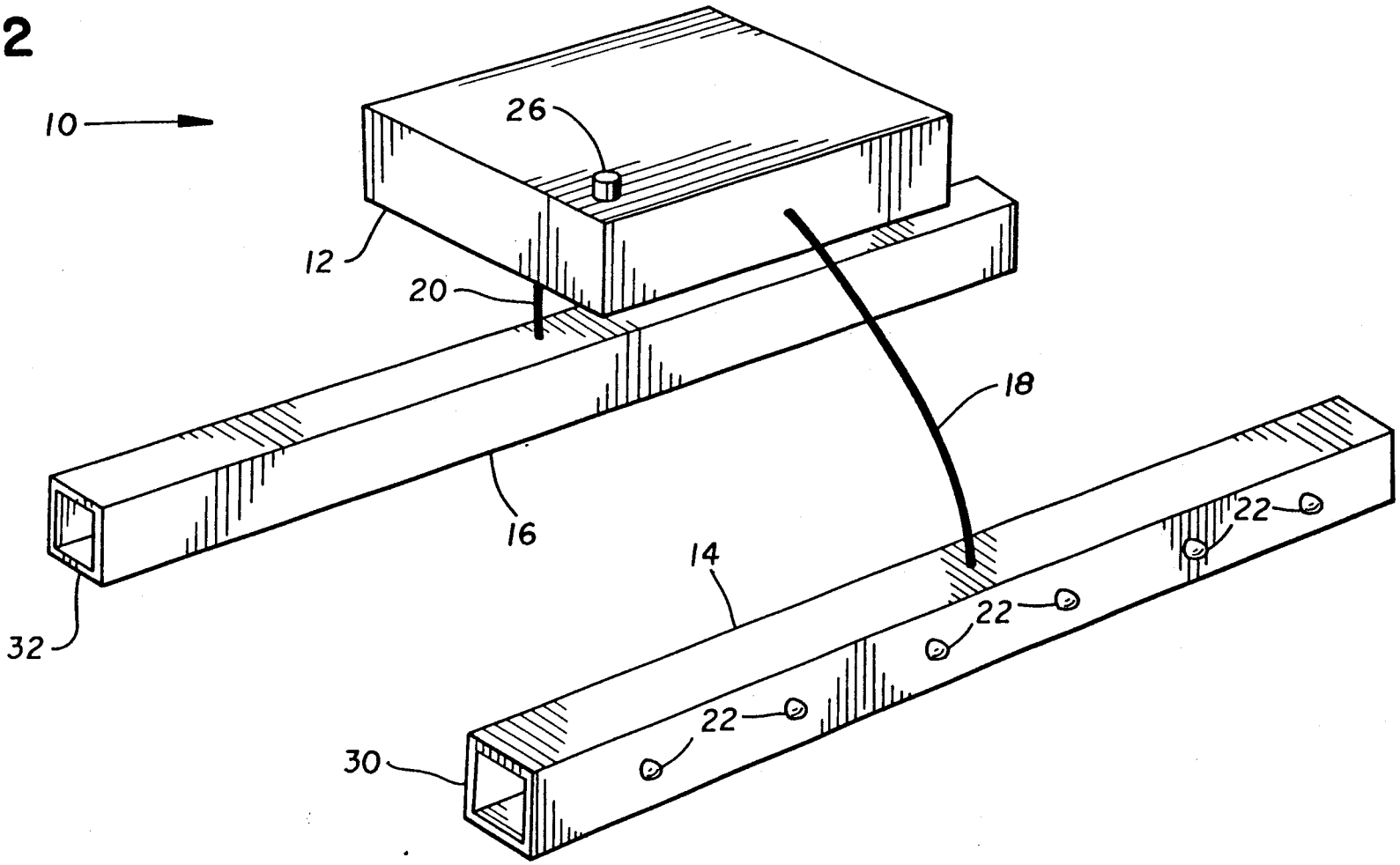
FIG. 2 is a perspective view of the battery and control box and lights of the present invention.

Referring now particularly to FIG. 2 of the drawings, the present invention will be seen to relate to a lighting apparatus 10 adaptable particularly to skates, such as the inline roller type skate S shown in FIG. 1. Lighting apparatus 10 comprises a central control box 12, first and second lighting arrays 14 and 16, and interconnecting first and second wiring leads 18 and 20. Each of the lighting arrays 14 and 16 contains one or more (preferably a plurality) lights 22, which lights 22 are preferably light emitting diodes (LEDs). Such LEDs are available in different colors, require relatively low power, and are relatively durable to provide relatively long life, particularly in a harsh environment as when attached to skates.

The electrical schematic shown in FIG. 3 more clearly shows the various components of the control box 12, as well as the electrical circuitry interconnecting the components. Control box 12 includes a power supply such as a battery or batteries 24, of suitable voltage for the operation of the selected number of lights or LEDs used in the present invention and for the operation of any other auxiliary devices. A prototype working model of the present invention makes use of four "button" type cells, as commonly used in calculators and hearing aids and the like, to provide power for ten LEDs arranged five to each light array. The resulting control box is of extremely small size, measuring some 2.25 by 1.25 by 0.31 inches. The advantages provided by such a small size control box 12 are apparent in the installation of control box 12 in a skate S, as will be discussed further below. While the drawing figures of the present invention show a total of six LEDs per array, it will be understood that the addition or subtraction of LEDs from each array is well within the scope of the present invention.

Control box 12 may also contain a switch 26, in series with the battery 24 as shown in FIG. 3. Switch 26 may be a slide, toggle, pushbutton, or any suitable type of electrical switch as desired. In addition to the above, a circuit 28 providing for the flashing of the lights 22 may be provided. Such a circuit 28 may be in the form of a miniaturized integrated circuit, as indicated in FIG. 3, or in any suitable form. A readily available commercially purchased integrated circuit (IC) was used in the construction of the prototype of the present invention. While such a flashing circuit 28 is not essential to the present invention, it does add an additional element of attraction as the lights alternately flash on and off to a preselected pattern when the present invention is in use.

The prototype of the present invention was constructed using a first and a second tube 30 and 32 to house the respective first and second lighting arrays 14 and 16. A series of appropriately sized holes were formed in each tube 30 and 32 for the installation of a corresponding number of lights 22, and a slit was formed in the opposite side for the insertion of the wiring harness for the lights 22. The components were then assembled and the slit was closed with double sided adhesive tape, the tape all providing for the temporary securing of each of the tubes 30 and 32 to each side of the blade support B of the skate S. The control box 12 is secured in the open arch area A of the skate S between the sole and the sides of the blade B, by means of double sided tape, hook and loop fastening material, or other means as desired.

The open arch area A has a pair of oppositely disposed laterally spaced surfaces 40 and 42. One of these surfaces is inwardly tapered as clearly shown at 42 in FIG. 1. so that the control box 12 can be pivoted toward arch A to wedge a portion of the control box into frictional engagement with inclined surface 42 as shown at 50 to releasably secure the control box within arch A of skate S between vertically extending surface 40 and inwardly inclined surface 42. Space 52 is provided between the control box 12 and blade B of skate S so that the control box may be pivoted toward blade B of skate S to release the control box 12 from a locked condition within arch A of skate S.

The temporary securing of the control box 12 in this manner provides for the removal of control box 12 for battery replacement or other work as needed. It will be apparent that other means may be used for the containment of the lighting arrays 14 and 16, such as tubes of round or other cross sectional shape, etc. In the event that metal tubes are used, the tube itself may serve as a ground for the lighting circuitry, thus simplifying the circuitry and wiring needed. Additional security and cushioning for the LEDs may be provided by surrounding each of the LEDs with an appropriately sized O ring (not shown) in order to retain each of the LEDs better in its hole or socket in the first or second tube 30 or 32.

With reference to FIG. 4, an example of the aforementioned double sided tape is indicated at 60, and includes a foam core 62, with layers 64, 66 on either side thereof, and a protective release liner 68 on the outer adhesive layer 66. This particular tape is currently commercially available and forms no part of the invention per se. Other tapes could be employed. With reference to FIGS. 1 and 4, the adhesive tape strip is applied to a tube 30, 32 on a side opposite that of the lights 22.

Lighting apparatus 10 is used by installing it on the skate S as described above, and turning on the switch 26 to activate the circuitry operating the lights 22. A skater using the present lighting apparatus 10 is thus made considerably more visible by means of the lights 22, particularly when they are in an intermittent flashing mode. Such lights render the skater, and the skating, much more exciting and attractive than otherwise. Moreover, a skater using the present invention outdoors at night, will be provided with much greater visibility than would otherwise be the case, thus being provided with much greater safety in traffic.

It is to be understood that the present invention is not limited to the sole embodiment described above, but encompasses any and all embodiments within the scope of the following claims.

I claim:

1. In combination with an in line skate having blade sides, a sole disposed above said blade sides, and an arch area disposed therebetween with said arch area having an opening therein, a lighting apparatus comprising:

a control box including electrical power means and switch means and having means for removably and adhesively installing said control box within said opening of said arch area of said skate;

lighting array means including light means, said lighting array means having means for temporarily, removably, adhesively, and releasably installing said lighting means along the blade side of said skate;

there being one lighting array means on each side of said skate, each said lighting array means comprising a square tube with individual lights, each individual light being a light emitting diode, and there further being double sided adhesive tape means along and coextensive with a selected side of said tube, opposite said lights, for temporary installation of each said lighting array means on the blade sides of said skate;

wiring means communicating between said control box and said lighting array means and retaining said control box and said lighting array means together as a unit;

said electrical power means providing electrical power for said lighting array means;

and said switch means providing for the selective operation of said lighting array means; whereby said control box is temporarily adhesively installed within said opening of said arch area and said lighting array means are temporarily adhesively installed on the blade sides of said skate and said switch means is actuated to operate said lighting array means including said light means on said skate, the mounting of said control box and said lighting array means on said skate being accomplished without need of modification of said skate in any manner.

2. The lighting apparatus of claim 1 wherein:

said control box includes a circuit providing for the intermittent flashing of said light means and said skate arch opening has a pair of opposed longitudinally spaced surfaces against which said control box is adapted to be wedged to releasably retain said control box within said skate arch opening, at least one of said opposed surfaces being tapered so that the longitudinal distance between said opposed surfaces is of greater length adjacent said blade and of lesser length adjacent said arch to facilitate entry of said control box into said skate arch opening, said control box being dimensioned so that it may be readily inserted within said arch opening and tilted toward said arch to tightly wedge said control box between said opposed surfaces to frictionally retain said control box within said arch opening, and said control box being adapted to be tilted toward said blade to remove said control box from said skate arch opening.

* * * * *